US007007608B2

(12) United States Patent
Flanagan

(10) Patent No.: US 7,007,608 B2
(45) Date of Patent: Mar. 7, 2006

(54) FLECHETTE PACKING ASSEMBLY

(76) Inventor: John Milan Flanagan, 1525 Moonter, Medford, OR (US) 97504

( * ) Notice: Subject to any disclaimer, the term of this patent is extended or adjusted under 35 U.S.C. 154(b) by 1 day.

(21) Appl. No.: 10/430,127

(22) Filed: May 5, 2003

(65) Prior Publication Data

US 2005/0022687 A1 Feb. 3, 2005

(51) Int. Cl.
*F42B 12/32* (2006.01)

(52) U.S. Cl. ..... 102/494; 102/703

(58) Field of Classification Search ..... 102/494, 102/703, 293

See application file for complete search history.

(56) References Cited

U.S. PATENT DOCUMENTS

| | | | | | |
|---|---|---|---|---|---|
| 477,492 | A * | 6/1892 | Benet | 102/494 |
| 1,244,046 | A * | 10/1917 | Ffrench | 102/494 |
| 3,613,586 | A * | 10/1971 | Talley et al. | 102/476 |
| 3,637,449 | A * | 1/1972 | Raech, Jr. | 156/305 |
| 3,730,093 | A * | 5/1973 | Cummings | 102/363 |
| 3,951,040 | A * | 4/1976 | Ziemba | 89/14.05 |
| 3,977,327 | A * | 8/1976 | Brumfield et al. | 102/494 |
| 4,192,234 | A * | 3/1980 | McCracken | 102/494 |
| 4,211,169 | A * | 7/1980 | Brothers | 102/494 |
| 4,662,281 | A * | 5/1987 | Wilhelm et al. | 102/494 |
| 5,325,786 | A * | 7/1994 | Petrovich | 102/438 |
| 5,440,994 | A * | 8/1995 | Alexander | 102/439 |
| 5,535,679 | A * | 7/1996 | Craddock | 102/494 |
| 5,753,851 | A * | 5/1998 | Jordan et al. | 102/427 |
| 5,796,031 | A * | 8/1998 | Sigler | 102/520 |
| 2003/0019386 | A1 * | 1/2003 | Lloyd et al. | 102/494 |

* cited by examiner

*Primary Examiner*—Harvey E. Behrend
*Assistant Examiner*—Bret Hayes

(57) ABSTRACT

A flechette packing assembly utilizing a flechette projectile having its aerodynamic stabilization elements within the body mass and below the body surface with a packing orientation of a 90-degree right angle to the intended axis of projection. The packing assembly of the described flechettes are placed within a shell body for discharge from a gun system, rocket warhead, or cluster bomblet. The flechette packing assembly orientation allows acceleration to any velocity without distortion or deformation of the flechette projectiles.

1 Claim, 6 Drawing Sheets

FLECHETTE PACKING ASSEMBLY

BACKGROUND OF THE INVENTION

This invention relates to the packing assembly of preformed anti-personnel or anti-material fragments known as flechettes for use in munitions fired from gun systems, delivered by rocket warheads, aircraft delivered bomblets.

In application it has been shown historically that ammunition designed for the distribution of preformed fragments have been more effective against personnel and materials than explosive munitions dependant upon shell casing fragmentation for effectiveness. Typically this type of artillery munition consisted of thin walled frangible shells which were randomly filled with spherical shot and fired directly at a target, and were the predominate type used for hundreds of years.

An improvement in the art was the invention of the spherical case shot by British Lieutenant Henry Shrapnel, which was adopted by the British military in 1852, and there evolved into the "shrapnel shell". This shell used spherical shot having flattened surfaces to align the packing. They were propelled from within the non-fragmenting shell body by a base explosive charge ignited by a time fuse when the shell was in the proximity of the target. It allowed an improved and more effective distribution of the preformed fragments in indirect artillery fire against distant targets.

A further improvement in the art was seen in U.S. Pat. No. 2,767,656 R. J. Zeamer in which the spherical shot was replaced with cylindrical slugs in closely arranged and stacked in self supporting vertical columns within a semi-frangible shell casing having a predefined release control. This was an improvement over similar munitions using spherical shot for target saturation with preformed fragments, but it lacked effectiveness in long-range applications.

An further improvement in the art was seen in the U.S. Pat. No. 3,956,990 John F. Rose in which the munition consisted of preformed fragments consisting of small finned darts, known in the art as flechettes, being assembled in round clusters and stacked within a semi-frangible shell body in layers separated by metallic disks and support rings. A base exploding charge activated by a fuse when the shell was in the proximity to the target dispenses the flechette clusters and support assemblies. This type of flechette packing has been the conventional standard for artillery and rocket munition use since it's invention.

An object of the present invention is to provide an elimination of several of the drawbacks in the prior art flechette packing, which include: generally complicated assembly techniques; a multitude of supporting assembly components which aerodynamically interfere with the distribution of flechettes upon release from the shell body, creating a wider than wanted dispersal area and reduced target saturation; Internal lateral rotation and axial movements of the flechette packing and supporting assembly components due to voids, causing unwanted gyroscopic effects that influences precision guidance; and the physical distortion and deformation upon the material body and fins of the prior art flechettes that resulting from the inertial setback forces developed during firing from conventional and high velocity gun systems.

BRIEF SUMMARY OF THE INVENTION

In the flechette packing assembly of the present invention the conventional flechettes used in the prior art are replaced with a type of flechette having a diamond shaped body with a front penetrating point and back stabilizer area having no aerodynamic stabilizing elements such as fins protruding from the body surface. The flechettes are arranged in a plane layer with the back stabilizers adjacent to one another creating a circular plane layer of flechettes with the central axis defining the flechette projectiles direction of flight in a packing orientation of a 90-degree right angle to the axis of projection. Successive circular plane layers of flechettes form a uniformly aligned stack of circular flechette plane layers surrounded with peripheral filler segments placed between the voids presented between the adjacent flechette penetrating points. Placed upon a base plate and wrapped with a layer of plastic the flechette packing assembly is inserted within a shell body.

When the flechette packing assembly of the present invention is fired from a gun the inertial setback forces that cause projectiles deformation which affects flight performance, have no effect on the flechette projectiles due to their packing orientation of a 90-degree right angle to the axis of projection. Along the axis of projection the peripheral fillers fall away from the flechette stack and base allowing the release of the flechettes to begin. During the in-flight release the flechette stabilizing elements align the penetrating points and axis of flight along the axis of projection as the flechettes travel towards the intended target. The flechette assembly packing of the present inventions has the ability to withstand high inertial forces and allows the use of flechettes in advanced gun systems having firing velocities many times higher than conventional weapons

DETAILED DESCRIPTION OF THE INVENTION

Figure 1:
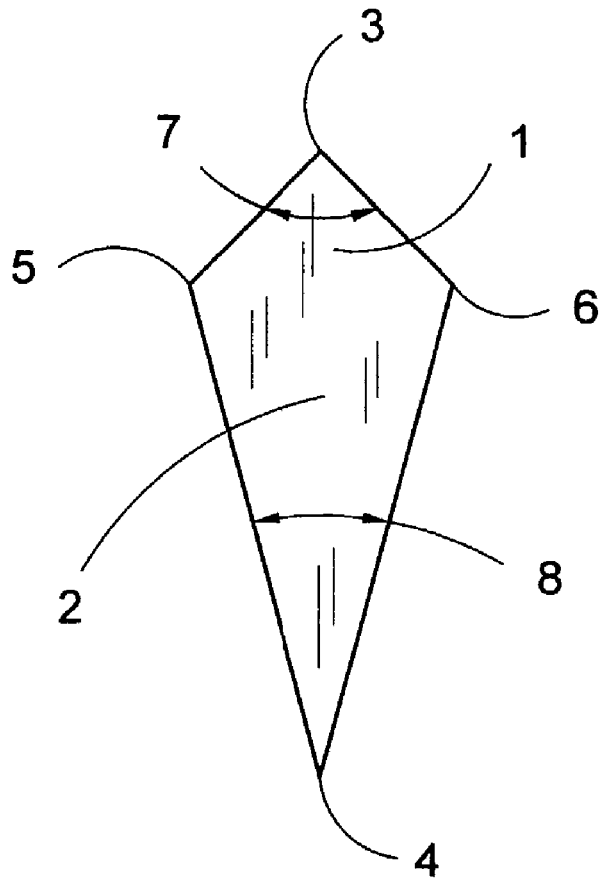
FIG. 1 is a top plan view of the described flechette projectile basic features, the opposite bottom plan view being a mirror image of that shown.

In the flechette packing assembly of the present invention the conventional flechettes used in the prior art are replaced with a type of flechette having a diamond shaped body with a front penetrating point and back stabilizer area having no aerodynamic stabilizing elements such as fins protruding from the body surface, instead having aerodynamic stabilizing elements placed within the flechette body. The diamond shaped flechettes are arranged in a plane layer with the back stabilizers adjacent to one another creating a circular plane layer of flechettes with the central axis defining the flechette projectiles direction of flight in a packing orientation of a 90-degree right angle to the axis of projection.

Each successive circular plane layer of flechette projectiles are place directly upon the preceding plane layer of flechette projectiles with all the penetrating points and central axes aligned with the same of the preceding layer. The uniformly aligned stack of circular flechette projectile plane layers are surrounded with peripheral filler segments placed between the voids presented between the adjacent flechette penetrating points. The packing has no voids within the assembly that would allow the infusion of air or the shifting of the projectiles. The flechette projectile stack and peripheral filler segments are placed upon a base plate and wrapped with a layer of plastic to maintain an integrity of the flechette packing assembly for handling when being inserted within a shell body. The flechette packing assembly is then inserted within a shell body and rests on the interior surface of the shell base.

When the flechette packing assembly of the present invention is fired from a gun the inertial setback forces that cause projectiles deformation as seen in the prior art which affects flight performance, have no effect on the flechette projectiles due to their packing orientation of a 90-degree right angle to the axis of projection. The inertial setback force load being applied along the axis of projection during firing is uniformly supported by each successive layer of projectiles within the packing eliminating any unsupported dynamic loading. As the flechette packing assembly is discharged from the shell body the plastic wrapper is immediately stripped away exposing the stack assembly to aerodynamic resistance. Along the axis of projection the peripheral fillers fall away from the flechette projectile stack and base allowing the release of the flechettes to begin. During the in-flight release the flechette stabilizing elements align the penetrating points and axis of flight along the axis of projection as the flechettes travel towards the intended target. With the addition of a precursor wave generator placed ahead of the flechette packing assembly the resulting control of the airflow around the flechette packing assembly can be adjusted to control the flechettes in-flight release. This allows for an early or late full free flight release of the flechettes for a specific target range.

The projectile deformations from inertial setback forces are characteristic of prior art flechette packing having the flechettes flight axis parallel with the axis of projection causing the bending of flechette bodies and distortion of their protruding stabilizing fins from unsupported dynamic loading, that deformation reduced flight performance and reduced target impact saturation from wider than optimal dispersal. The flechette assembly packing of the present inventions has the ability to withstand high inertial forces and allows the use of flechettes in advanced gun systems having firing velocities many times higher than conventional weapons. These advanced gun systems such as high energetic propellant systems, electromagnetic rail gun systems, or plasma dynamic systems could utilize the present invention.

FIG. 1 shows the basic features of the flechette projectile of the present invention, having a diamond shaped body formed from the junction of a front penetration point 1 and a back stabilizer 2. The front penetration point 1 is formed by an isosceles triangle from front point 3 to left point 5 and right point 6, with an included angle of 7 to 90 degrees. The included angle 7 of the front penetration point 1 may be of any angle other than the preferred angle described which forms a point for target penetration and places the center of gravity ahead of the projectiles center of pressure. The back stabilizer 2 is formed by an isosceles triangle from back point 4 to left point 5 and right point 6, with a preferred included angle of 4 to 30 degrees. The central axis of the projectile body extends from front penetration point 1 through back point 4 and correspond to the projectile flight axis. The included angle 8 of the back stabilizer is that portion of a circle which when equally divided by the number of flechette projectiles desired representing an equal segment of a 360 degree circle for a circular packing layer, and may be of any angle other than the preferred angle described for arrangements other than circular. The length of the flechette body measured from front point 3 to back point 4 is determined by the radius measured from the center of the shell body minus the shell body thickness. If the resulting preferred body length were unsuitable for a specific application or arrangement the body length may determined as a length less than the radius value described.

Figure 2:
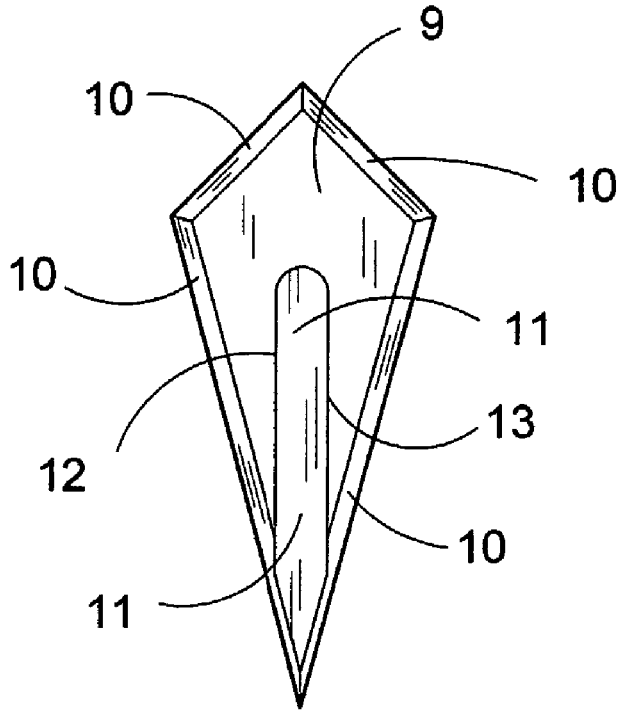
FIG. 2 is a top plan view of the described flechette projectile preferred embodiment, the opposite bottom plan view being a mirror image of that shown.

Shown in FIG. 2 is the top plan view of the preferred embodiment of the flechette, the opposite bottom plan view being a mirror image of that shown, having a diamond shaped body with a plane surface 9, a peripheral cutting edge 10 formed by an included angle of 45 degrees from the top and bottom plane surfaces meeting at a point of unity which may encompass all or part of the bodies periphery, a channel 11 depressed to certain depth within the plane surface 9, and aerodynamic stabilization element edge 12 and aerodynamic stabilization element edge 13 formed at the intersecting edges of channel 11 and plane surface 9.

Figure 3:
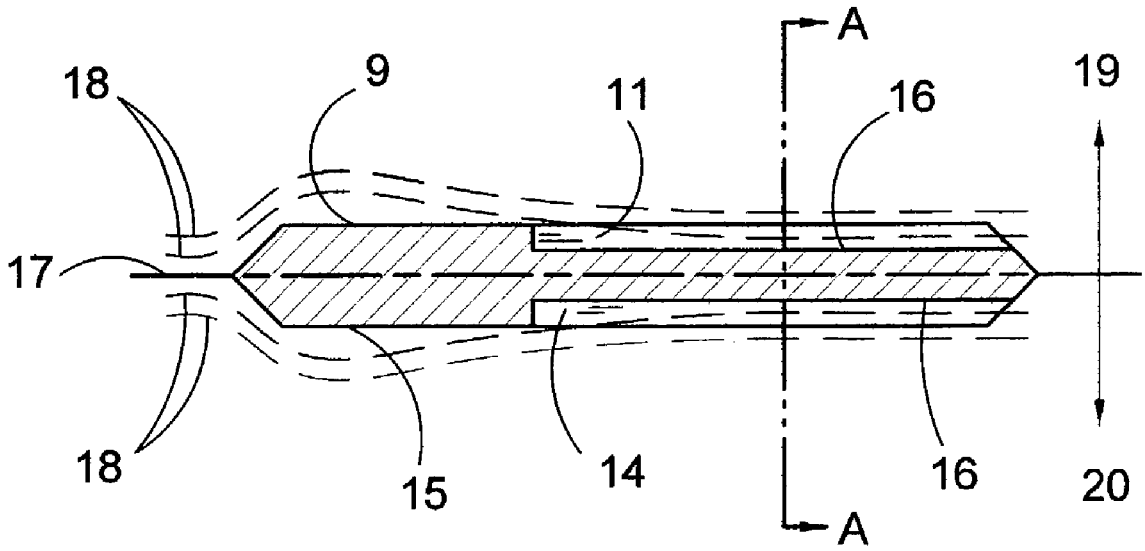
FIG. 3 is a side sectional view showing the flechette projectiles embodied aerodynamic stabilization elements.

The side sectional view FIG. 3 shows the flechettes embodied aerodynamic stabilization elements. The thickness of the flechette body being the material distance between top plane surface 9 and bottom plane surface 15 in the preferred embodiment is 0.060 to 0.190 inches, or a thickness of 1 to 100 percent of the measured distance between left point 5 and right point 6. The top channel 11 and bottom channel 14 extend below the top plane surface 9 and bottom plane surface 15, the preferred embodiment limits the depth of top channel 11 and bottom channel 14 equally so that a material web 16 remains to separate the two channels within the body.

The length of top channel 11 and bottom channel 14 in the preferred embodiment from back point 4 along its central axis forward toward front point 3 is limited by that length which maintains the center of gravity ahead of the center of pressure, or a length no further than a line extending between left point 5 and right point 6. The width of top channel 11 and bottom channel 14 in the preferred embodiment is twice the depth of either channel, or a width determined by the volume of either channel necessary for the flechettes aerodynamic pitch and yaw stabilization.

The flechette requires aerodynamic stabilization of pitch for optimized flight when projected as a free flight body, the top channel 11 and bottom channel 14 allow the formation of positive aerodynamic lift effects, which act to stabilize the flechette along the flight axis 17 projected through the center of the projectile from the front point 3 to back point 4.

As the airflow 18 travels across the flechettes top plane surface 9 and bottom plane surface 15 a pressure differential is introduced into top channel 11 and bottom channel 14 creating a low-pressure area above the channel volumes parallel with the body plane surfaces. This low-pressure area acts to equalize the orientation of the flechette in flight as the top plane surface 9 or bottom plane surface 15 pitches above 19 or pitches below 20 the flight axis 17.

Figure 4:
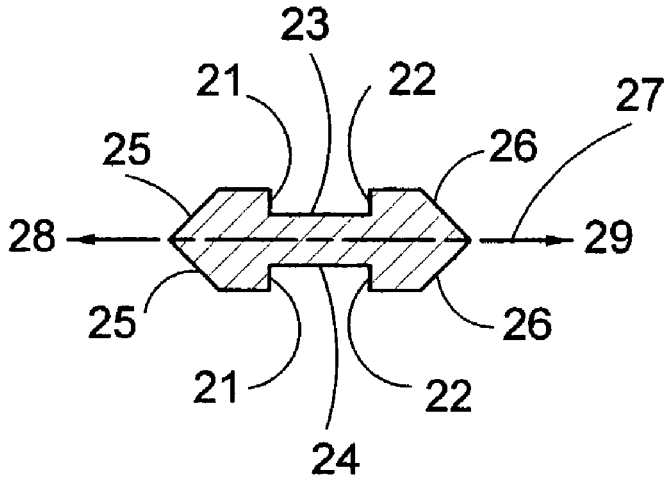
FIG. 4 is a sectional view A—A of FIG. 2 showing the flechette projectiles additional embodied aerodynamic stabilization elements.

FIG. 4 shows side sectional view A—A with the additional embodied aerodynamic stabilization elements of the left channel sides 21 and right channel sides 22 within top channel 11 and bottom channel 14, that intersect with top plane surface 9 and bottom plane surface 15 and top channel bottom 23 and bottom channel 24 with an included angle of 90-degrees. Other included angles between the channel sides and channel bottoms that maintain desired aerodynamic effect may be used. The left channel sides 21 and right channel sides 22 act as reversed fin stabilization elements, placing the aerodynamically interacting surface within the body of the projectile, as opposed to conventional fin stabilization surfaces well known in the prior art which protrude from a projectile body.

The flechette requires aerodynamic stabilization of yaw for optimized flight when projected as a free flight body, the airflow 18 when introduced into top channel 11 and bottom channel 14 allow its interaction with left channel sides 21 and right channel sides 22 and the exertion of aerodynamic pressure upon the channel sides. The exertion of the aerodynamic pressure acts to equalize the orientation of the flechette in flight as the left side surface 25 or right side surface 26 yaw left 28 or yaw right 29 along yaw axis 27.

The flechette material in the preferred embodiment is sintered tungsten carbide, in a suitable grade for optimum penetration performance in the designated target material and for cost effectiveness in mass production. Other materials may be found suitable for specific target applications, with the front penetration point 1 being constructed of a material differing from the rear stabilizer 2 and joined together by whatever method suitable to the chosen materials, such as ceramic composite, aluminum, or plastic, etc.

Figure 5:
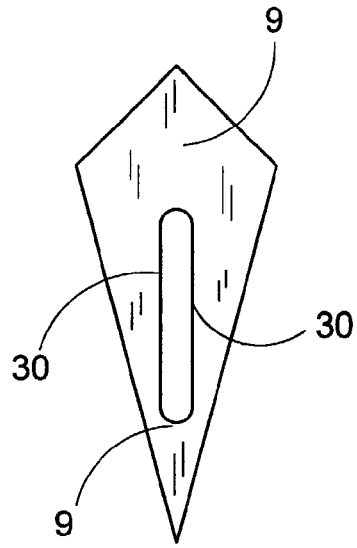
FIG. 5 is a top plan view of flechette projectile described within the present invention having a simplified construction, the opposite bottom plan view being a mirror image of that shown.

Shown in FIG. 5 is a top plan view of a flechette projectile within the present invention having a simplified construction, the opposite bottom plan view being a mirror image of that shown. The flechette consists of a diamond shaped body as previously described with a plane surface 9 that eliminates the peripheral cutting edge 10 of the preferred embodiment. The flight stabilization elements embodied in top channel 11 and bottom channel 14 are eliminated and replaced by perforation 30 through the body, with the length and width constraints the same as the channels of the preferred embodiment. The simplified flechette construction may be formed from sheet material, such as steel, using standard industrial stamping or cutting processes. The perforation 30, which provides similar aerodynamic stabilization characteristics as seen in the channels of the preferred embodiment, may be extended through the body past back point 4 to facilitate production, but may exhibit a reduced correction of pitch along the flechettes free flight axis 17.

Figure 6:
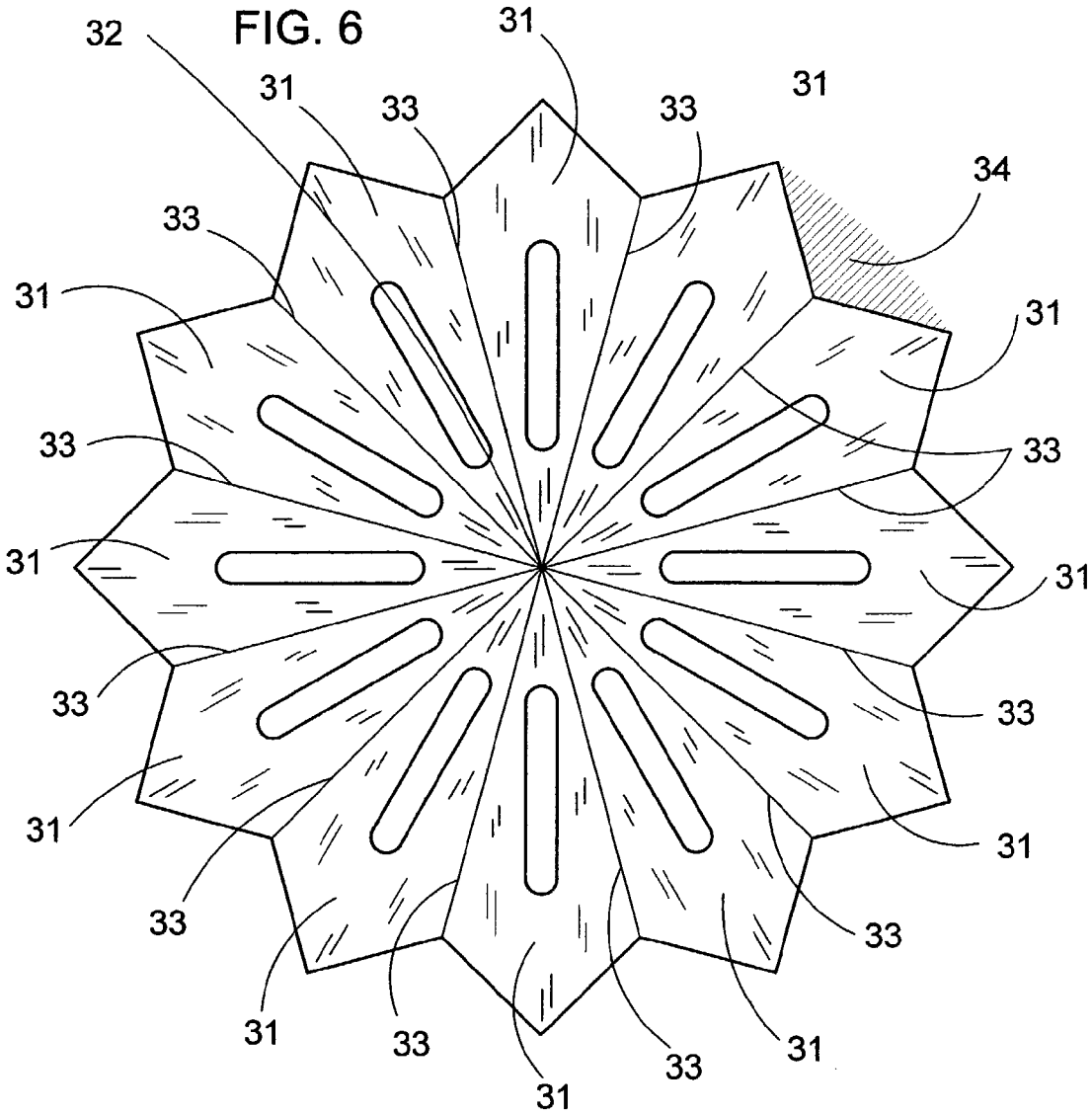
FIG. 6 is a top plan view of a circular arrangement of flechette projectiles.

Shown in FIG. 6 is a top plan view of a circular arrangement of flechette projectiles in a single plane layer, the flechettes 31 are of the type shown in FIG. 5 having simplified construction for purposes of clarity. Each flechette 31 is arranged with the back point 4 located in axial alignment on or near the center of the circular plane layer arrangement 32, with each flechettes rear stabilizer edge 33 placed parallel with the edge of each adjacent flechettes rear stabilizer edge 33, having each flechette body contributing an equal segment of the 360 degree circle forming the circular plane arrangement. This circular plane layer arrangement of flechettes has multiple defined voids 34 between each adjacent flechettes 31 front penetration point 1 surrounding the arrangement. The circular plane layer arrangement of flechettes being the preferred embodiment, any arrangement pattern of flechettes other than circular resulting in a single plane layer may be used.

Figure 7:
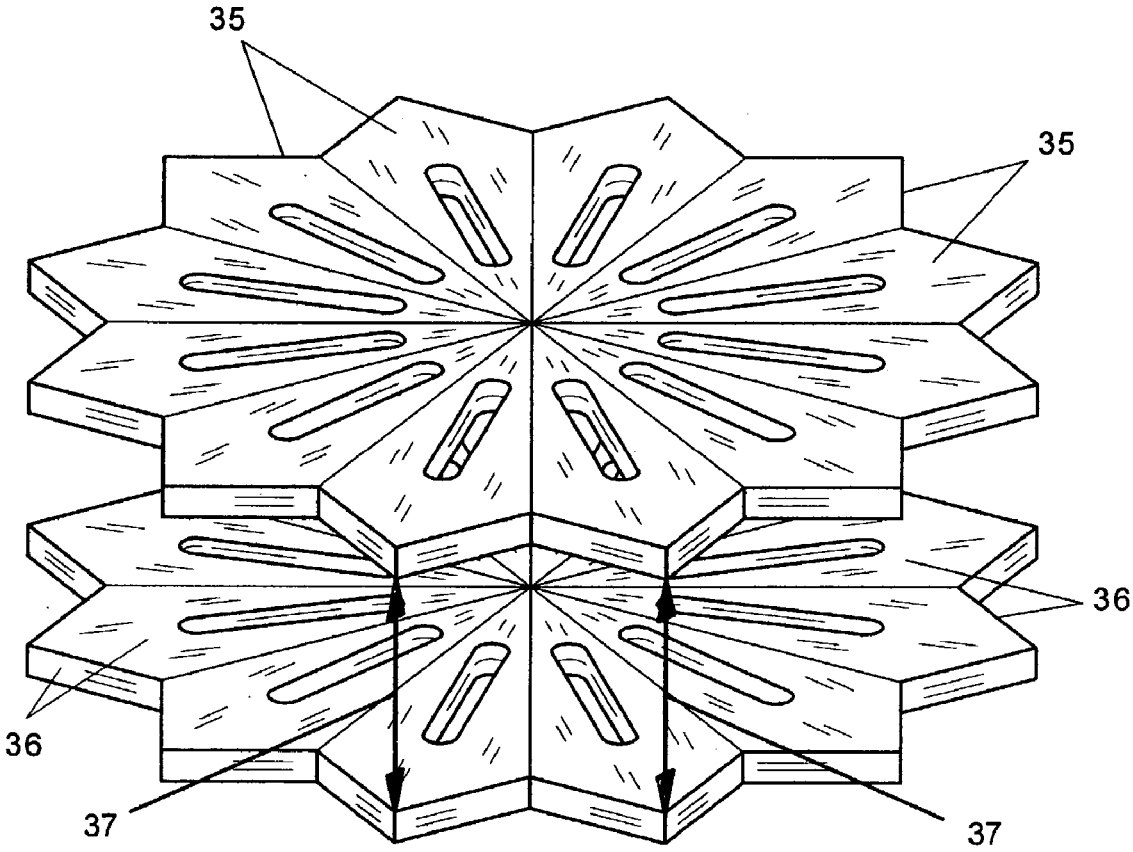
FIG. 7 is a top perspective view of the layering of two circular arrangements of flechette projectiles.

Shown in FIG. 7 is a top perspective view of the layering of circular plane layer arrangements of flechette projectiles having simplified construction for purposes of clarity. The top circular plane layer 35 is placed directly upon the bottom circular plane layer 36, having all penetration points 1 of circular plane layer 35 in parallel alignment 37 aligned with all penetration points 1 of circular plane layer 36 placing the central axis of each projectile of each circular plane layer in a vertical alignment.

Figure 8:
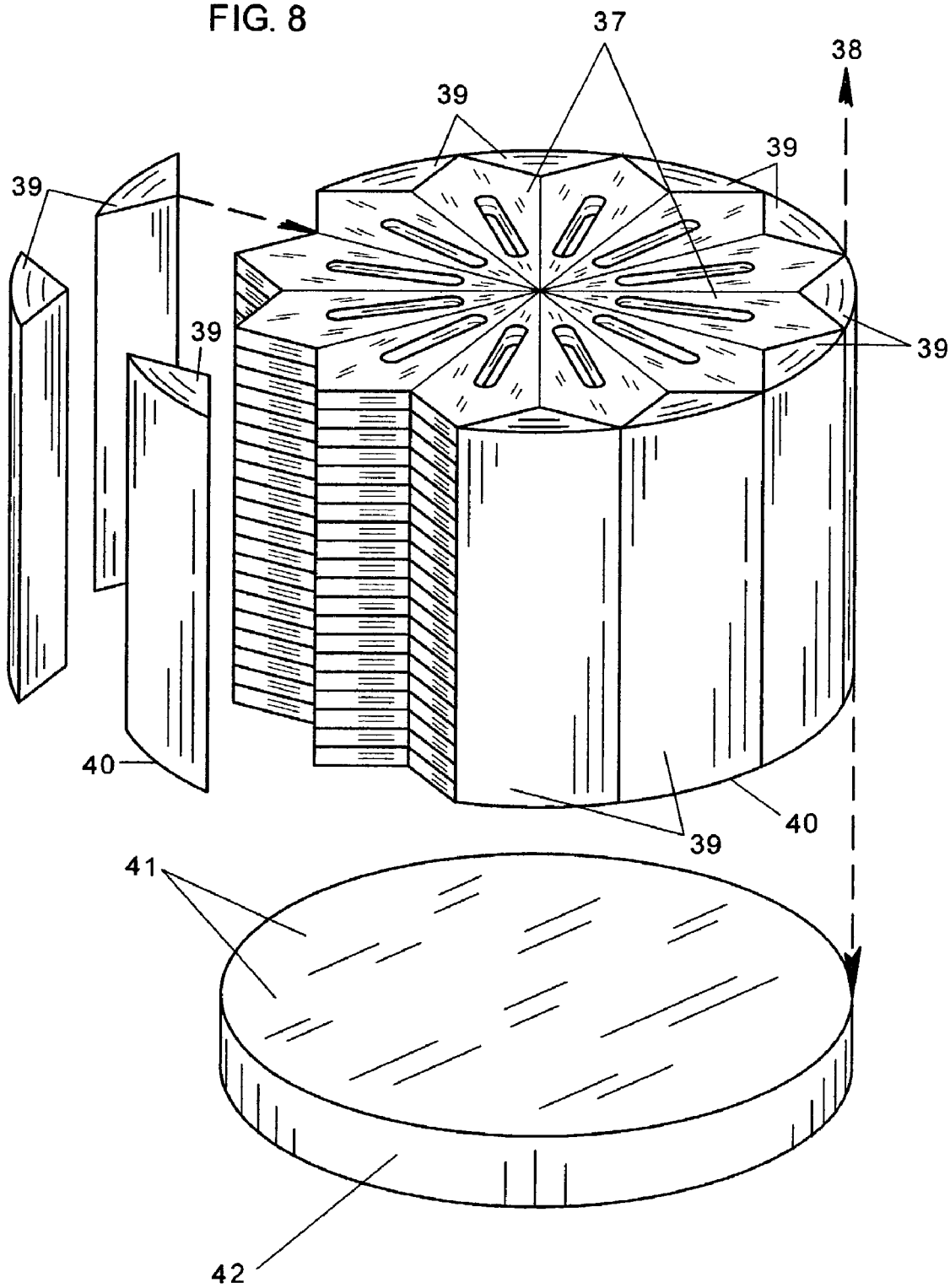
FIG. 8 is a perspective view of the flechette packing assembly consisting of circular arrangements of flechettes and peripheral filler segments and base plate.

Shown in FIG. 8 is a perspective view of the flechette packing in an assembly of layers of circular plane layer arrangements of flechettes and peripheral filler segments. The stack 37 of parallel aligned circular plane layer arrangements of flechettes are resting at a 90-degree right angle to the axis 38 of munition projection. Placed within the multiple defined voids 34 are peripheral filler segments 39, which serve to hold the stack 37 of circular plane layer arrangements of flechettes in alignment, the peripheral filler segments 39 having a curvature of the outer surface 40 which matches the inside surface of the interior of the shell body that the packing assembly is to be placed in, and has a length equal to the height of the stack 37. The peripheral filler segments 39 may be individual as shown in the preferred embodiment, or may be joined as necessary into segments of peripheral fillers for mechanical considerations, and may be of lengths shorter or longer than the preferred embodiment but which fill the multiple defined voids 34. The stack 37 circular plane layer arrangements of flechettes and peripheral filler segments 39 are placed in circumferential alignment on the outer circular boundary of base plate 42 resting upon its plane surface 41. The base plate 42 in the preferred embodiment must have an outer circular boundary equal to the outer circular boundary of stack 37 and peripheral filler segments 39 in order to fully support the assembly. In the preferred embodiment base plate 42 must also have a material thickness sufficient to resist flexural distortion and deformation when subjected to the inertia of the flechette packing assembly when it is accelerated to the desired velocity.

Figure 9:
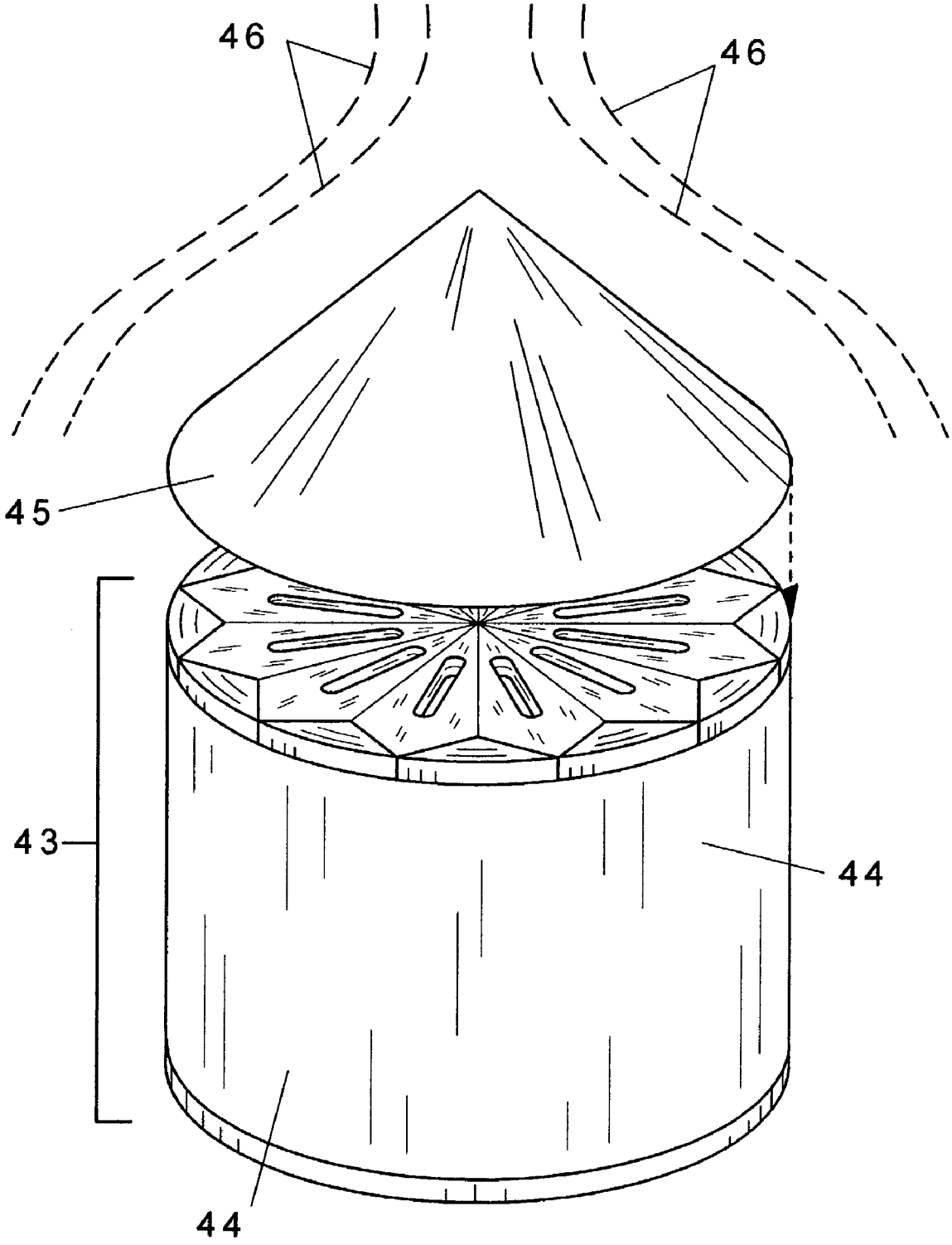
FIG. 9 is a perspective view of the flechette packing assembly and a precursor wave generator.

Shown in FIG. 9 is a perspective view of the flechette packing assembly 43, wrapped with a layer of plastic film 44 to maintain the alignment integrity of the packing assembly for handling when being inserted within a shell body, and a precursor wave generator 45 having a conical aerodynamic shape in the preferred embodiment, which generates an aerodynamic wave front preceding the flechette packing assembly 43. The precursor wave generator 45 directs airflow around 46 the sides of the flechette packing assembly 43 as it is accelerated to the desired velocity. The precursor wave generator 45 is placed on end opposite the base plate 42 location. The precursor wave generator 45 shapes is not limited by the preferred embodiment, any aerodynamic shape found effective might be used.

In the preferred embodiment the precursor wave generator 45 has an outer circular base boundary equal to the outer boundary of the flechette projectile packing assembly 43. That reduces the interaction of the directed airflow 46 surrounding with the flechette packing assembly 43 and increases the in-flight homogeneity of the flechette packing assembly 43 as it travels along the axis of projection 38, placing the ultimate free flight release of the individual flechette projectiles closer to the intended target and reducing the overall projectile dispersal.

In an alternative embodiment the precursor wave generator 45 may also have an outer circular boundary less than the outer boundary of the flechette projectile packing assembly 43. That increases the interaction of the directed airflow 46 surrounding with the flechette packing assembly 43 and reduces the in-flight homogeneity of the flechette packing assembly 43 as it travels along the axis of projection 38, placing the ultimate free flight release of the individual flechette projectiles further from the intended target and increasing the overall projectile dispersal.

I claim:

1. A flechette canister packing consisting of:

(a) a circular vertical stack of diamond shaped flechettes assembled using 10 to 10,000 circular layers of diamond shaped flechette bodies;

(b) and within each circular layer of diamond shaped flechettes are positioned a plurality of diamond shaped flechette bodies;

(c) and each diamond shaped flechette body within the plurality represents a segment of a circle having an included angle of 4 to 30 degrees;

(d) and each diamond shaped flechette body within the plurality is positioned in contact with each adjacent flechette body edge;

(e) and the combination of the included angles of the diamond shaped flechette body segments within the plurality equal a 360 degree circular layer;

(f) and each circular layers of diamond shaped flechettes is positioned upon each adjoining circular layer of diamond shaped flechettes forming a vertical stack;

(g) and the flechette body edges within each circular layer of diamond shaped flechettes are positioned in contact with the flechette body edges of each adjoining circular layer of diamond shaped flechettes within the vertical stack;

(h) and there is no empty space between any circular layers of diamond shaped flechettes within the vertical stack;

(i) and there are no separating material bodies placed between any circular layers of diamond shaped flechettes within the vertical stack;

(j) and the circular vertical stack of diamond shaped flechettes is positioned within the circular cavity of a projected munition shell body.

* * * * *